US007602353B2

(12) United States Patent
Lacoste et al.

(10) Patent No.: US 7,602,353 B2
(45) Date of Patent: Oct. 13, 2009

(54) METHOD FOR DRIVING A PLASMA DISPLAY WITH MATRIX TRIGGERING IN STAGES

(75) Inventors: Ana Lacoste, St Martin le Vinoux (FR); Dominique Gagnot, Charavines (FR); Pascal Denoyelle, Meylan (FR)

(73) Assignee: Thomson Licensing, Boulogne-Billancourt (FR)

( * ) Notice: Subject to any disclaimer, the term of this patent is extended or adjusted under 35 U.S.C. 154(b) by 679 days.

(21) Appl. No.: 10/883,543

(22) Filed: Jul. 1, 2004

(65) Prior Publication Data

US 2005/0068259 A1 Mar. 31, 2005

(30) Foreign Application Priority Data

Jul. 3, 2003 (FR) ..... 03 08084

(51) Int. Cl.
*G09G 3/28* (2006.01)

(52) U.S. Cl. ..... 345/60; 345/36; 345/37; 345/67

(58) Field of Classification Search ..... 345/60, 345/36–37, 67
See application file for complete search history.

(56) References Cited

U.S. PATENT DOCUMENTS 4,292,631 A * 9/1981 Gerard ..... 345/71
6,084,559 A * 7/2000 Nagao et al. ..... 345/67
6,380,912 B1 4/2002 Kang et al. ..... 345/60
6,483,491 B1 11/2002 Lee ..... 345/60
2002/0008678 A1 1/2002 Rutherford ..... 345/60
2002/0030645 A1 3/2002 Lee et al. ..... 345/68
2006/0103597 A1* 5/2006 Ito ..... 345/63

OTHER PUBLICATIONS

San-Hun Jang et al., "Improvement of Luminance and Luminous Efficency Using Address Voltage Pulse During Sustan-Period of AC-PDP"IEEE Transactions On Electron Devices vol. 48,No. 9 Sep. 2001, XP-001082146 p. 1902-1910.

* cited by examiner

*Primary Examiner*—Richard Hjerpe
*Assistant Examiner*—Leonid Shapiro
(74) *Attorney, Agent, or Firm*—Robert D. Shedd; Harvey D. Fried; Patricia A. Verlangieri

(57) ABSTRACT

Method comprising a succession of image frames which each comprise a sustain phase of the display discharge regions which itself comprises the application of sustain voltage pulses $V_S$ between the electrodes of each pair crossing these regions, and, during each sustain pulse, the application of trigger voltage pulses $V_M$ to groups of discharge regions, which pulses are applied successively and not simultaneously to the various groups of discharge regions.

Thanks to the application in stages of the trigger pulses during each sustain pulse, a reduction in the instantaneous current required to supply the display is obtained.

18 Claims, 5 Drawing Sheets

METHOD FOR DRIVING A PLASMA DISPLAY WITH MATRIX TRIGGERING IN STAGES

This application claims the benefit, under 35 U.S.C. § 119 of French Patent Application 0308084, filed Jul. 3, 2003.

1/ BACKGROUND OF THE INVENTION

The invention relates to a method for driving a plasma screen for displaying images comprising discharge regions each positioned at an intersection of a pair of coplanar sustain electrodes and an address electrode, the said method comprising a succession of image frames or subframes which each comprise a reset phase, an address phase for selectively activating display discharge regions and a sustain phase for the discharge regions, the said sustain phase comprising:

the application of sustain voltage pulses between the electrodes of each pair designed to initiate, under the effect of a trigger pulse, plasma discharges between these electrodes solely in the regions with pre-activated discharges, in synchronization with these sustain pulses, the application of trigger voltage pulses, designed to trigger these discharges, between one of the electrodes of each pair and the address electrodes.

2/ PRIOR ART

Document US 2002/0030645 describes such a method applied to an AC plasma display with memory effect comprising two plane panels, one front and one rear, enclosing between them a space filled with discharge gas which is partitioned into discharge regions, notably by means of barrier ribs disposed between the panels; the front panel carries two arrays of coplanar sustain electrodes which are coated with a dielectric layer providing the memory effect; each electrode of one of the arrays forms a pair with an electrode of the other array; the rear panel carries an array of address electrodes which are oriented perpendicularly to the sustain electrodes.

The image display system described in the document US 2002/0030645 therefore comprises means for generating the voltage pulses between the display electrodes, in particular a sustain generator that supplies the coplanar electrode pairs.

Such a driving method applied to such a display allows discharges to be triggered between the sustain electrodes of each pair, even when there is a wide gap separating them, without having to increase the voltage of the sustain pulses; thanks especially to greatly extended discharges being obtained between these electrodes, such a driving method allows the luminous efficiency of plasma displays with coplanar sustain electrodes to be very significantly improved.

Applying the same sustain voltage pulses between the electrodes of each pair of the display initiates discharges simultaneously in all the pre-activated regions of the display and requires a sustain generator capable of supplying the sum of the currents of all these simultaneous discharges; the sustain generator components need to be sized to generate very high instantaneous currents; this requirement is all the more demanding the higher the number of discharge regions, which is the case for display screens having large dimensions and/or a high resolution.

Document U.S. Pat. No. 4 316 123—IBM—describes a solution to this problem: instead of applying the sustain voltage pulses to all the electrode pairs of the display simultaneously, these pulses are applied in stages so as to trigger the sustain discharges in stages; the maximum instantaneous currents drawn from the sustain generator by the display are thus significantly reduced, which allows less costly generators to be employed.

3/SUMMARY OF THE INVENTION

An objective of the invention is to propose another solution to this problem, in the case where a driving method such as that described in the document US 2002/0030645 is used.

For this purpose, the subject of the invention is a method for driving a plasma screen for displaying images comprising discharge regions each located at an intersection of a pair of sustain electrodes and an address electrode, the said method comprising a succession of image frames or subframes which each comprise a sustain phase of the discharge regions which itself comprises the application of sustain voltage pulses $V_S$ between the electrodes of each pair, and, during each sustain pulse, the application of trigger voltage pulses $V_M$ to groups of discharge regions of the display, the sustain pulses being inadequate on their own for initiating discharges between the electrodes of the pairs, and the trigger pulses being designed to trigger these discharges in combination with the sustain pulses, characterized in that the trigger pulses are applied successively and not simultaneously to the various groups of discharge regions during the period of each sustain pulse.

In practice, each trigger pulse causes a potential difference $V_M$ between one of the electrodes of each pair from the regions of a group and each address electrode from the regions of this group; the pulse can be obtained either by applying it directly to the address electrodes, or by superimposing complementary pulses of opposite sign onto the sustain pulses for each electrode of the sustain pairs while keeping the potential of the address electrodes constant.

When the trigger pulse is directly applied to the address electrodes, each group of discharge regions corresponds to a group of address electrodes or display columns, to which are simultaneously applied the same trigger pulse; the address or column electrodes are thus divided into various groups and, according to the invention, during the period of each sustain pulse, a trigger pulse is successively applied to the various groups of address electrodes.

According to the invention, the fact that each group of discharge regions receives its own trigger pulse in succession leads to the sustain discharges being initiated in stages between these various groups during each sustain pulse: the total instantaneous current drawn by the discharges is thus significantly reduced which allows less costly, and maybe smaller, sustain generators to be used.

In order to obtain stable discharges in the display and to optimize the luminous efficiency, the duration $\tau_M$ of the trigger pulses should be shorter than the duration $\tau_S/2$ of the sustain pulses.

Preferably, in order to optimize the driving method of the invention, during the period of each sustain pulse, the trigger pulses are applied to the various groups of discharge regions in stages of uniform duration.

Preferably, if $\delta t$ is the interval between two successive trigger pulse applications, and if $\sigma_{1/2}$ is the width at half-height of the average curve of the current intensity of the discharges between the electrodes of the pairs as a function of time, $\delta t$ is chosen such that $\delta t \geqq \sigma_{1/2}$.

The time delay between the discharges in the various groups will then be long enough to allow the total instantaneous current of the discharges to be divided by a factor corresponding virtually to the number of discharge region groups.

Preferably, for each sustain pulse which comprises an approximately constant voltage plateau $V_S$, between a voltage rising edge and a voltage falling edge, the interval of time $\tau_R$ that separates the beginning of the said plateau and the first application of a trigger pulse is less than 100 ns. The reason for this is that in order to best guarantee the stability of the discharges, the distributed sequences of triggers should be started right from the beginning of the sustain pulse plateau.

Preferably, prior to each sustain phase, each frame or subframe also comprises an address phase for selectively activating discharge regions of the display, and the trigger pulses are able to trigger the discharges in combination with the sustain pulses solely in the pre-activated discharge regions.

Preferably, prior to each address phase, each frame or subframe further comprises a reset phase for the discharge regions. This reset phase conventionally comprises a charge equalization or "priming" operation and a charge erase operation.

4/ BRIEF DESCRIPTION OF THE DRAWINGS

The invention will be better understood upon reading the description that follows, presented as a non-limiting example and with reference to the appended figures, in which.

Figure 7:
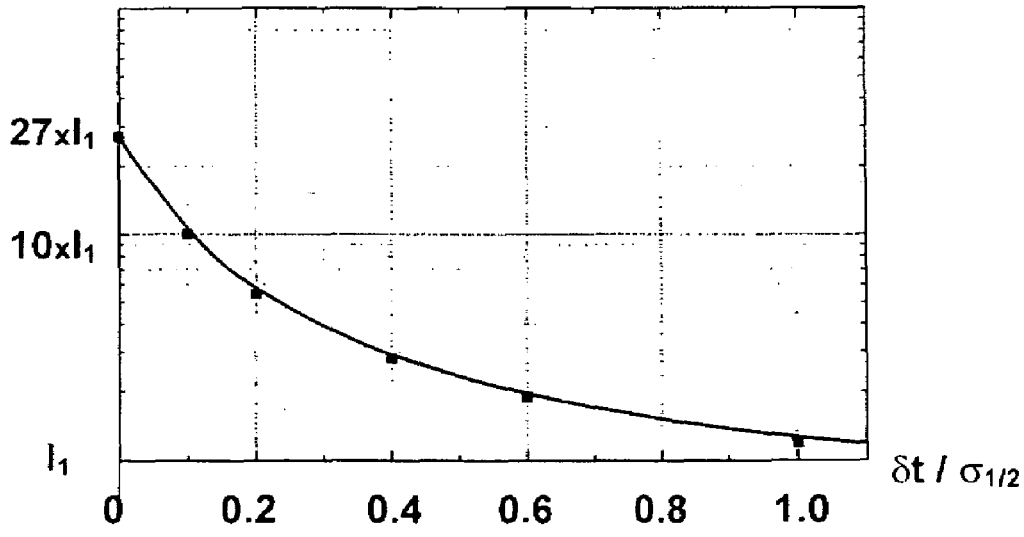

FIG. 7 shows the maximum current intensity that the plasma display sustain generator needs to be able to generate as a function of the ratio $\delta t/\tau_{1/2}$, where $\delta t$ is the interval between two successive applications of trigger pulses, and where $\sigma_{1/2}$ is the width at half-height of the average curve of the sustain discharge current intensity as a function of time, in the case where there are 27 discharge region groups, and where $I_1$ is the current required for widely spaced out trigger pulses ($\delta t >> \sigma_{1/2}$).

The figures showing timing diagrams do not take into account the true value scale in order that certain details will be more clearly visible than if the true proportions had been respected.

5/ Preferred Embodiments

Figure 1:
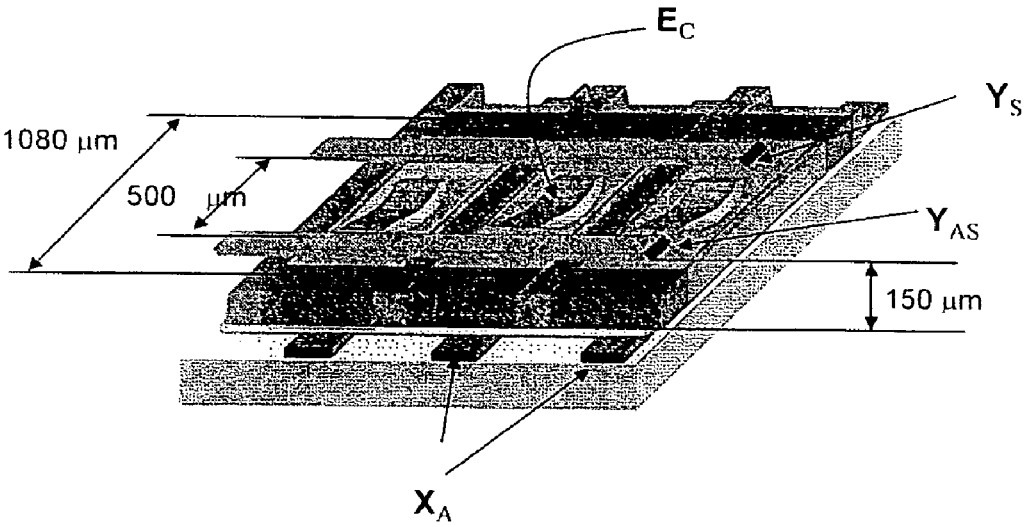
FIGS. 1 and 2 illustrate a plasma display to which the invention applies.
Figure 2:
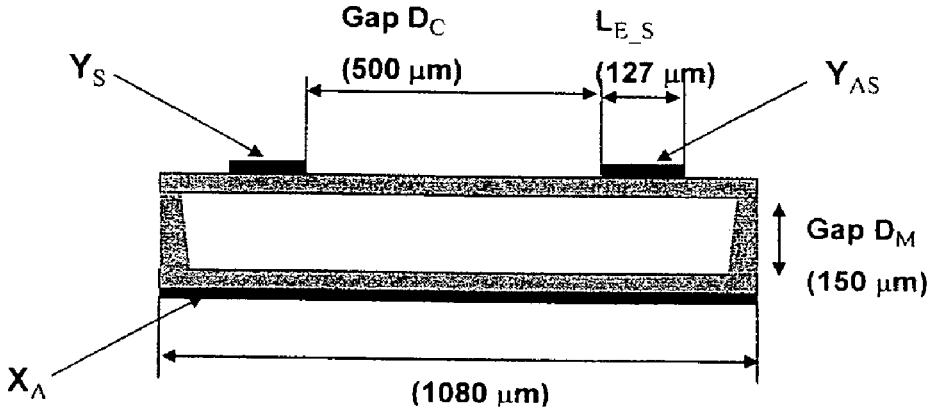

With reference to FIGS. 1 and 2, the plasma display, to which the driving method according to the invention will be applied, comprises two flat panels, one front and the other rear, creating a space between them that is filled with discharge gas, here of thickness 150 μm; the front panel carries two coplanar sustain electrode arrays, which are coated with a dielectric layer (not shown); each electrode $Y_S$ of one of the arrays forms a pair with an electrode $Y_{AS}$ of the other array; the rear panel carries an array of address electrodes $X_A$, which are oriented perpendicularly to the sustain electrodes; in between the panels there is a network of barrier ribs that partition the space between the panels into discharge regions; there is a barrier rib between each sustain electrode pair; there is also a barrier rib in between each address electrode; the boundaries of each cell or discharge region of the display are thus defined by the panels and by the barrier ribs.

The distance separating the coplanar electrodes of any given pair, or gap $D_C$, is greater than the distance separating these electrodes from the address electrode at their crossing point; thus, the coplanar gap $D_C$ here is 500 μm, whereas the thickness of the discharge gas or matrix gap $D_M$ is 150 μm.

The width of the coplanar sustain electrodes $L_{E_S}$ here is only about 127 μm, whereas in general it is much greater in coplanar displays without matrix triggering in order to create therein a discharge expansion region over the width of these electrodes.

The rear panel of the display and the side faces of the barrier ribs are coated with phosphors which, when excited by the ultraviolet radiation from the discharges, emit the different primary colours of the images to be displayed; FIG. 1 shows three cells of different colours, red, green and blue, which form one pixel of the display.

Here, the distance between two adjacent rows of cells or two pairs of electrodes is 1080 μm.

All the numerical values are given above by way of an example and in no way limit the scope of the invention.

As will be seen hereinafter, one of the electrodes of each pair, $Y_{AS}$, is also used for addressing.

Figure 3:
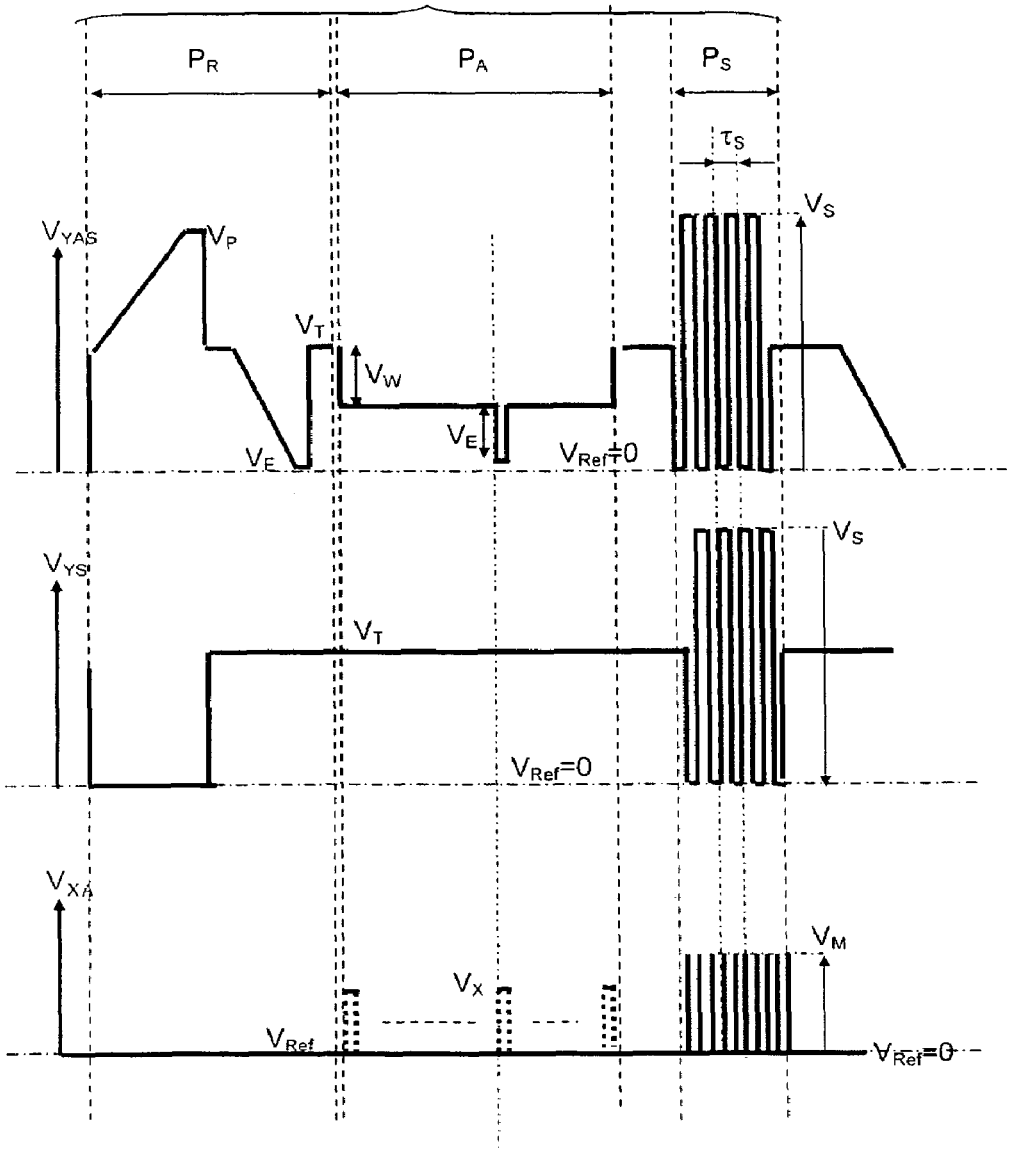
FIG. 3 shows timing diagrams of voltage signals applied to the display electrodes, in one embodiment of the invention.

In order to display an image on the plasma display in operation, a succession of scans, or sometimes subscans, of the discharge regions to be activated or not are performed in the conventional way; with reference to FIG. 3, each scan or subscan comprises the following successive steps:

- a discharge region reset step $P_R$, here comprising a charge equalization operation called "priming" and a charge erase operation; these operations are conventionally achieved by applying linear voltage ramp signals;
- a selective address step $P_A$ whose aim is to deposit electrical charges onto the portion of dielectric layer in the discharge regions to be activated, by applying at least one voltage pulse between the address electrodes $Y_{AS}$, $X_A$ crossing each other within these regions; this deposition of charge in the discharge regions corresponds to the activation of these discharge regions;
- then, a non-selective sustain step $P_S$ during which a succession of voltage pulses $V_S$ are applied between the coplanar electrodes $Y_S$, $Y_{AS}$ of the sustain pairs and a succession of trigger pulses $V_M$ between the electrodes $Y_{AS}$ of the front panel and the address electrodes $X_A$ of the rear panel, so as to initiate a succession of luminous discharges $E_C$ solely in the discharge regions which are situated between these coplanar electrodes and which have been pre-activated.

FIG. 3 shows three timing diagrams of voltage pulses: that applied to the sustain and address electrodes $Y_{AS}$, that applied to the sustain-only electrodes $Y_S$ and that applied to the address electrodes $X_A$ which cross the sustain electrodes $Y_{AS}$, $Y_S$ within each cell. These timing diagrams show a series of successive phases all belonging to the same scan or subscan cycle of the plasma display.

The rest of the description of the invention presents results obtained with a plasma display as described above which is filled with an Ne/4% Xe gas mixture at a pressure of $0.6\times10^5$ Pa, and whose coplanar electrodes are supplied by a sustain generator delivering AC sustain pulses at a frequency of 150 kHz.

The sustain frequency of 150 kHz corresponds to a half-period $\tau_S/2$ of 3333 ns which represents the maximum plateau duration for the sustain pulses, if the voltage rise and fall times are very short and if there is no intermediate voltage plateau in between. In practice, it can be clearly seen in FIG. 4A that the duration $\tau_P$ of this plateau is less than the half-period $\tau_S/2$.

The address electrodes $X_A$ or columns are supplied by an address pulse $V_X$ generator, or by a trigger pulse $V_M$ generator, via column drivers that allow each address electrode to be connected or not to one or the other of these generators; here, these column drivers are grouped in units of 92 drivers, so that, for 2592 columns, in other words 2592/3=864 pixels per row, there are 27 units across the whole width of the display.

Figure 4A:
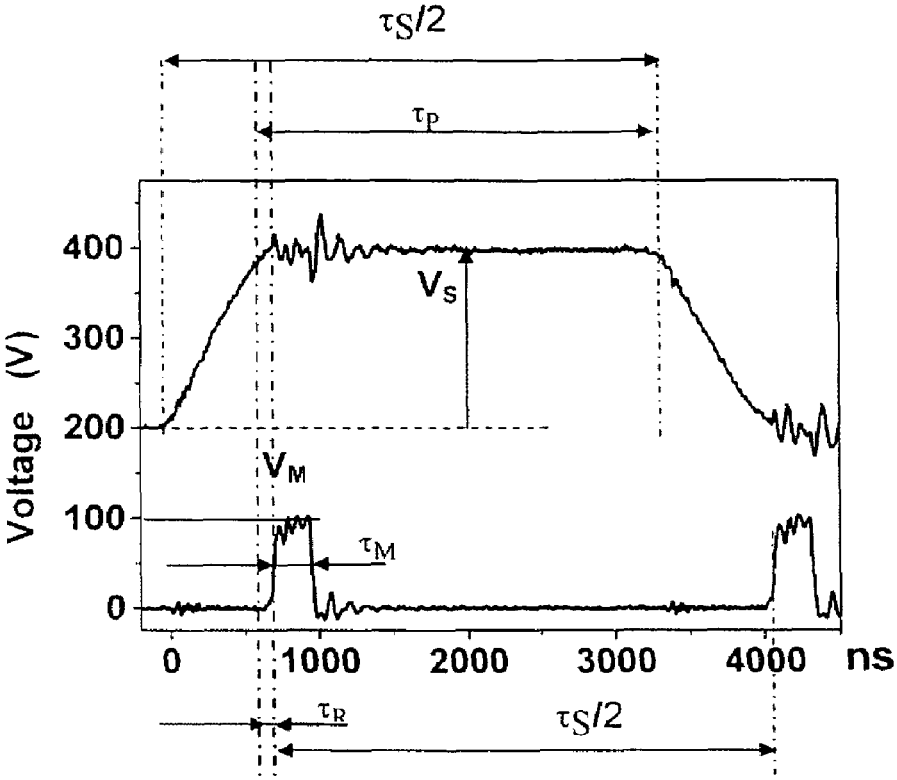
FIG. 4A shows a sustain voltage pulse $V_S$ applied between the coplanar electrodes of a discharge region and a trigger pulse for the discharge between these electrodes applied between one of these electrodes and the address electrode crossing this region.
Figure 4B:
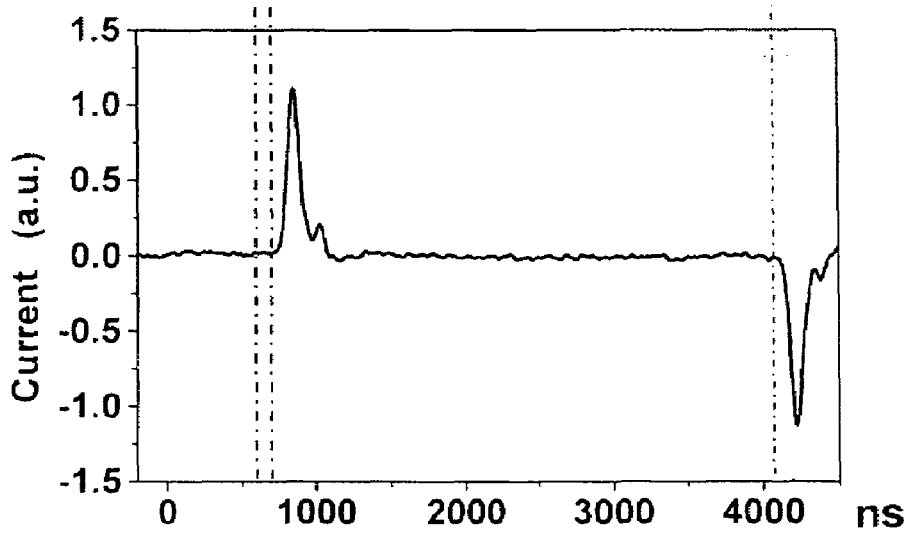
FIG. 4B shows the discharge current flowing between the coplanar electrodes in arbitrary units (a.u.).

Taking $V_S$=200 V and $V_M$=100 V as shown in FIG. 4A, coplanar discharges are obtained whose current is shown in FIG. 4B in arbitrary units; according to the invention, the voltage $V_S$ is chosen to be lower than the minimum sustain voltage $V_{S\text{-}min}$ that would allow coplanar discharges to be obtained with $V_M$=0 V. Thus, for $V_S$=200 V and $V_M$=0 V, no coplanar discharge would be obtained.

Integrating the voltage rise and fall times, the duration of a sustain pulse corresponds to a sustain half-period $\tau_S/2$=3333 ns; the duration of a trigger pulse here is $\tau_M$ which is much smaller than $\tau_S/2$ and here is equal to around 600 ns; $\tau_M$ should be long enough to trigger the coplanar discharges effectively and short enough to obtain a good luminous efficiency; in practice, $\tau_M$ is generally less than 1 μs.

The trigger pulse characteristics, namely their amplitude, their duration and the timing of their application with respect to the timing of the application of a sustain pulse, are optimally chosen with respect to the characteristics of the discharges regarding, in particular, their efficiency and their luminance; this optimization can readily be achieved by those skilled in the art.

Having fixed the coplanar potential $V_S$ below the minimum sustain potential $V_{S\text{-}min}$, and having fixed the amplitude and the duration of the trigger pulses $V_M$ so as to obtain a stable operation for all of the display cells, the invention consists of applying these trigger pulses in stages, over the duration of a sustain half-period, to all of the address or column electrodes of the display.

According to the invention:

- the same trigger pulses are applied simultaneously to all the address electrodes of a particular group corresponding to the same unit of drivers; each group therefore comprises 96 column electrodes;
- from one group of address electrodes to another, the trigger pulses are shifted by a non-zero time interval which is less than the sustain half-period so that each address electrode receives a trigger pulse during each sustain pulse;
- the trigger pulse shifts of the various groups are staggered over time such that the trigger pulses of one group never coincide with the trigger pulses of another group; preferably, the pulses are distributed uniformly over time and the time delay between two successive groups is then denoted δt.

Such a pulse distribution scheme according to the invention does not imply that the trigger pulses of one group of electrodes are ended when the trigger pulses of the next group begin, which means that the delay between two successive groups δt may be much smaller than the duration of the trigger pulses $\tau_M$.

Figure 5A:
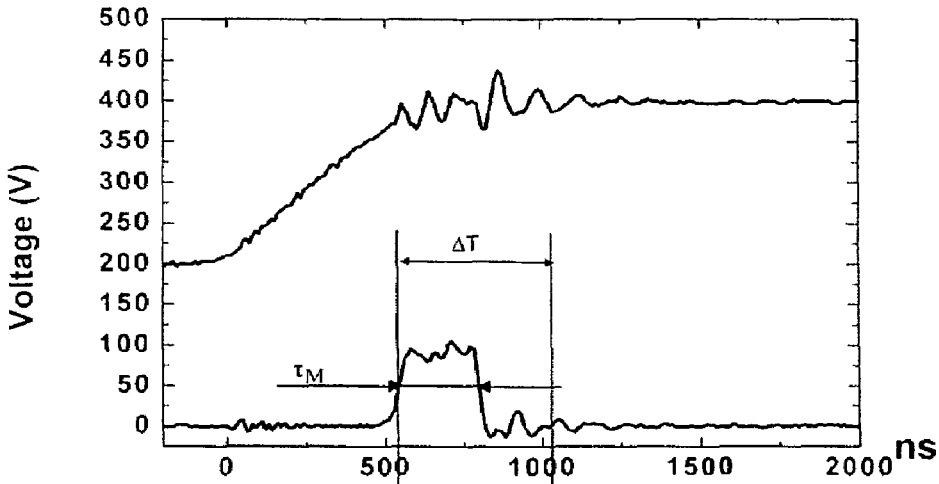
FIGS. 5A and 5B show the same sustain voltage pulse $V_S$ and, respectively, a first trigger pulse for a first group of display address electrodes and a last trigger pulse for a last group of display address electrodes which is delayed relative to the others according to the invention.
Figure 5B:
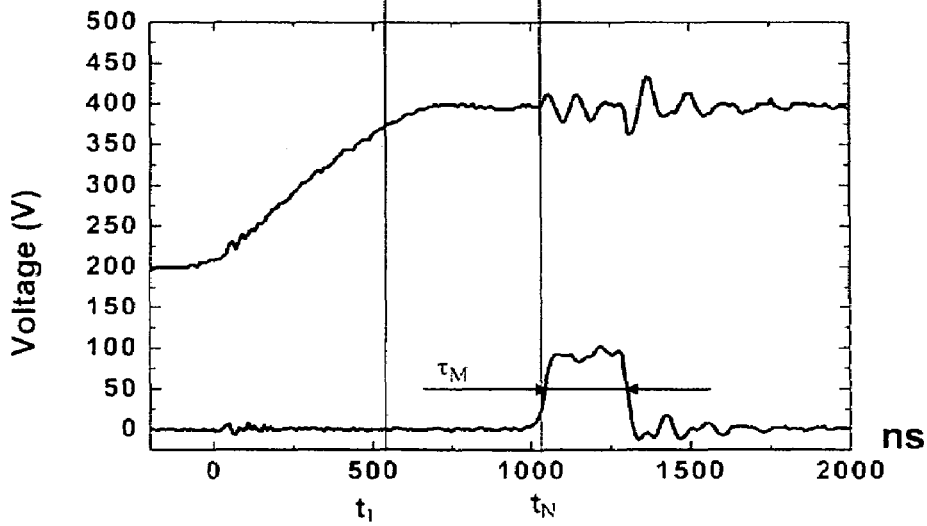

According to the invention and as illustrated in FIGS. 5A and 5B, if ΔT is the interval of time between the time $t_1$ when the first trigger pulse is applied and the time $t_N$ when the $N^{th}$ and last trigger pulse is applied ($\Delta T=t_N-t_1$) during one sustain pulse, the N trigger pulses, applied in stages over the duration of the sustain pulse, are applied over the N=27 column driver units with a delay between two consecutive pulses of $\delta t=\Delta T/N$ as follows:

1. driver 1—pulse applied at $t_1=t$,
2. driver 2—pulse applied at $t_2=t+\delta t$,
3. driver 3—pulse applied at $t_3=t+2\delta t$,
4. . . . ,
5. driver i—pulse applied at $t_i=t+(i-1)\ \delta t$,
6. driver 27—pulse applied at $t_{27}=t+26\delta t$.

The number of trigger discharges distributed over time and separated by δt will therefore be $N=\Delta T/\delta t$.

Thanks to this distribution of the trigger pulses over time and between the various groups of columns, the maximum instantaneous current that must be delivered by the display sustain generator is very significantly reduced, which allows its cost and size to be reduced.

The maximum instantaneous current obtained by distribution of the pulses depends on the value of the delay δt between two successive pulses relative to the duration of the discharge current as shown in FIG. 7. Taking $I_1$=1 (normalized) the maximum intensity of the current in the discharges triggered by the simultaneous application of a trigger pulse via the 92 column drivers of one particular unit, and $\sigma_{1/2}$ its width at half-height, the maximum current that the display sustain generator must deliver is in the range between:

1. $I_N=N\times I_1$ in the case of the prior art where the pulses are applied to all the units simultaneously (δt=0), and
2. $I\cong 1.2\times I_1$ in the case of a delay δt equal to the width at half-height, in other words $\delta t=\sigma_{1/2}$.

As an example, for a delay $\delta t=0.2\times\sigma_{1/2}$, the maximum instantaneous current of the whole set of discharges is $I\cong 5.4\times I_1$, which means a reduction by a factor 27/5.4=5 in the current that must be supplied by the display sustain generator thanks to the invention.

The maximum instantaneous current of the whole set of discharges is divided exactly by the number N of units $I=I_N/N=I_1$ if the delay between two successive trigger pulses is greater than the width at half-height of the discharge current, in other words $\delta t>>\sigma_{1/2}$.

Preferably, with reference to FIG. 4A, at each sustain pulse, the distributed series of trigger pulses is initiated as soon as possible; preferably, the interval of time $\tau_R$ which separates the beginning of a sustain pulse plateau and the first application of a trigger pulse is less than 100 ns.

The practical application of the invention must also take into account, on the one hand, the maximum possible interval ΔT between the first and the last pulse during the sustain half-period and, on the other hand, the frequency of the clock that controls the column drivers.

The interval ΔT between the first and the last trigger pulses applied during the same sustain pulse is clearly less than the duration of this sustain pulse; the maximum admissible value of the interval ΔT is conditioned by the necessity for obtaining stable triggered discharges between the coplanar sustain electrodes, even when they are triggered by the most delayed trigger pulses towards the end of the sustain pulse plateau. For example, for a half-height width $\sigma_{1/2}$ of 100 ns, a delay time $\delta t=\sigma_{1/2}$ leads to an interval $\Delta T=\sigma_{1/2}\times N=100\times 27=2700$ ns. It should therefore be ensured that the trigger pulse that is delayed by 2700 ns relative the first trigger pulse does indeed trigger stable sustain discharges. If this is the case, this advantageous distribution of the pulses allows the total current that needs to be supplied by the sustain generator to be reduced by a factor of 27/1.2=22.5 with respect to the case of simultaneous application of the trigger pulses of the prior art, in other words without delays.

It has in fact been verified that the trigger pulse delays do not significantly affect the luminous efficiency of the discharges: approximately the same luminous efficiency for delays of 450 ns, 550 ns, 700 ns, 1100 ns and 1250 ns have been obtained.

In practice, the delay $\delta t$ between the pulses applied to each column driver unit (96 columns) is controlled by a clock whose frequency corresponds to this delay. Thus, a delay $\delta t$ of 100 ns requires a clock with a frequency of 10 MHz.

If the frequency of the sustain pulses is too high and does not allow the whole series of trigger pulses to be distributed over an interval of 2700 ns, the interval $\Delta T$ between the first and the last pulse should then be reduced. A reduction in this interval $\Delta T$ leads to a reduction in the delay $\delta t$ between successive trigger pulses and, consequently, requires the frequency of the control clock to be increased. For example, a delay $\delta t$ of 20 ns between successive pulses applied to each column driver unit requires a clock with a frequency of 50 MHz. In this situation, $\delta t$=20 ns, and for a half-height width of the current in a unit $\sigma_{1/2}$=100 ns, the interval over which the pulses are distributed is reduced to $\Delta T=\delta t \times N=20\times 27=540$ ns. As shown in FIG. 7, for $\delta t=0.2\times\sigma_{1/2}$, the total current that the sustain generator needs to supply is reduced by a factor of 5.

An advantageous variant of the invention will now be described.

Owing to the fact that the discharges are not all triggered at the same moment within the cells relative to the beginning of the sustain pulse plateau, differences in luminance between the cells corresponding to various groups of columns may be observed.

In order to solve the problem posed by the differences in luminance between the mutually delayed discharges, the pulses can be advantageously triggered, in rotation, at different moments during the subframe as follows:

1. driver 1—pulse applied at $t_1$, then at $t_2$, then at $t_3, \ldots, t_{27}$
2. driver 2—pulse applied at $t_2$, then at $t_3$, then at $t_4, \ldots,$ then at $t_{27}$, then at $t_1$
3. . . .
4. driver i—pulse applied at $t_i$, then at $t_{i+1}$, then at $t_{1+2}, \ldots$, then at $t_{i-1}$
5. driver 27—pulse applied at $t_{27}$, then at $t_1$, then at $t_2, \ldots, t_{26}$.

Thanks to this variable distribution of electrode groups between the various application times $t_1, t_2, \ldots, t_N$ of the trigger pulses during the same sustain pulse, the differences in luminance between the mutually delayed discharges can be compensated over several scans or subscans.

Figure 6:
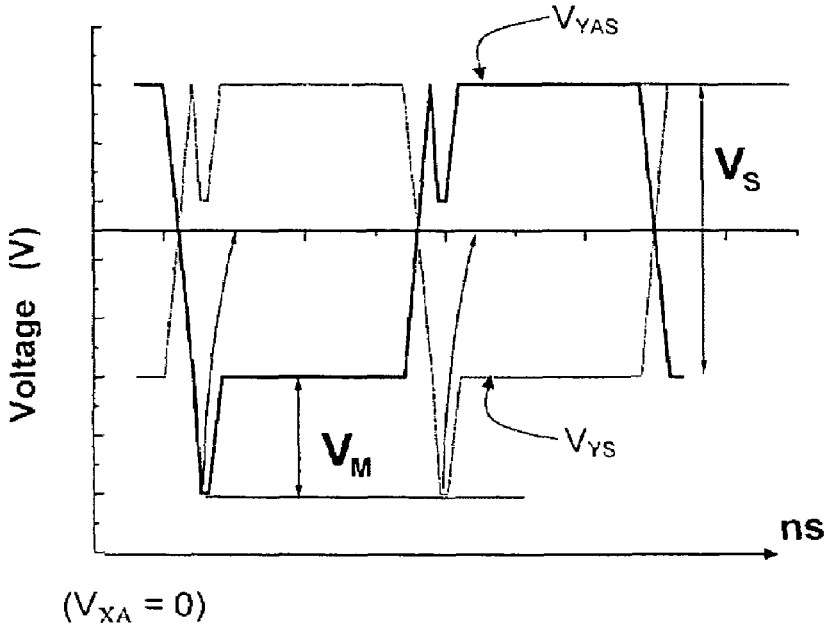
FIG. 6 shows a variant to the timing diagrams in FIG. 3 relating to the sustain phase, for obtaining the trigger pulses.

According to another variant of the invention, the trigger pulses can be obtained by keeping the potential of the address electrodes constant, while superimposing complementary pulses, of opposite sign, onto the sustain pulses for each electrode of the sustain pairs, as shown in FIG. 6.

Although the embodiments heretofore described are applicable to what are called "wide-gap" discharges, the invention may be applied to all types of coplanar discharge, including discharges of the "narrow-gap" type, as long as they are capable of operating at a sustain potential below the extinction limit when they are controlled by matrix trigger pulses. It is advantageous that the geometry of the electrodes be designed for the purpose.

The main advantage afforded by the invention is a reduction in the cost of the electronics, in particular the sustain generator. As described previously, the distribution of the discharges controlled by time-shifted pulses allows the total current to be divided by the number of column driver units. Thus, the peak current supported by the row drivers and by the sustain generator can be reduced in the same proportion, and the size of the sustain generator is proportional to the peak current.

An implicit advantage of the invention is the increase of the discharge luminous efficiency; indeed, the superimposition of the trigger pulses $V_M$ on the sustain potential $V_S$ allows the power dissipated in the discharge to be reduced, thanks to the simultaneous reduction of the sustain potential $V_S$ and the discharge current; whatever the position of the trigger pulse during the sustain pulse plateau, the current in the discharges controlled by the trigger pulse is less than that which would be obtained at the sustain minimum $V_{S\text{-}min}$ in the absence of pulses: this is explained by the fact that, following the matrix ignition $V_M$, the coplanar discharge is maintained at a potential $V_S$ lower than $V_{S\text{-}min}$.

What is claimed is:

1. Method for driving a plasma screen for displaying images comprising discharge regions each located at an intersection of a pair of sustain electrodes and an address electrode, said method comprising a succession of image frames or subframes which each comprise a sustain phase of the discharge regions which itself comprises the application of sustain voltage pulses $V_S$ between the electrodes of each pair, and, during each sustain pulse, the application of trigger voltage pulses VM to groups of discharge regions of the display, the sustain pulses being inadequate on their own for initiating discharges between the electrodes of the pairs, and the trigger pulses being designed to trigger these discharges in combination with the sustain pulses, wherein the trigger pulses are applied successively in stages and not simultaneously to the various groups of discharge regions during the period of each sustain pulse.

2. Method for driving according to claim 1, wherein the duration $\tau_M$ of the trigger pulses is shorter than the duration $\tau_S/2$ of the sustain pulses.

3. Method for driving according to claim 1, wherein, during the period of each sustain pulse, the trigger pulses are applied to the various groups of discharge regions in stages of uniform duration.

4. Method for driving according to claim 3, wherein if $\delta t$ is the interval between two successive trigger pulse applications, and if $\sigma_{1/2}$ is the width at half-height of the average curve of the current intensity of the discharges between the electrodes of the pairs as a function of time, $\delta t$ is chosen such that $\delta t \geqq \sigma_{1/2}$.

5. Method for driving according to claim 1, wherein, for each sustain pulse which comprises an approximately constant voltage plateau $V_S$, between a voltage rising edge and a voltage falling edge, the interval of time $\tau_R$ that separates the beginning of said plateau and the first application of a trigger pulse is less than 100 ns.

6. Method for driving according to claim 1, wherein, prior to each sustain phase, each frame or subframe also comprises an address phase for selectively activating discharge regions of the display, and in that the trigger pulses are able to trigger the discharges in combination with the sustain pulses solely in the preactivated discharge regions.

7. Method for driving according to claim 6 wherein, prior to each address phase, each frame or subframe further comprises a reset phase for the discharge regions.

8. A method for driving a plasma screen having a plurality of discharge regions that are distributed along paired electrodes and are distributed over different triggering groups, comprising the steps of:

supplying a succession of image frames or image sub-frames;

generating a sustain phase of the discharge regions for each image frame or image sub-frame, supplying sustain voltage pulses to said discharge regions during said sustain phases, utilizing said paired electrodes, the sustain voltage pulses being incapable on their own of triggering discharges in said discharge regions;

during each of the sustain pulses, supplying trigger pulses at different times to said discharge regions such that the discharge regions of each triggering group are supplied at the same time by the trigger voltage pulse;

distributing the trigger voltage pulses at different times over the duration of the sustain pulse such that these different trigger pulses are applied successively; and, triggering discharges in said discharge regions utilizing trigger pulses in combination with said sustain pulses.

9. The method of claim 8, further comprising the step of generating said trigger pulses to be shorter in duration than said sustain pulses.

10. The method of claim 8, wherein the distribution of the successive trigger voltage pulses over the duration of the sustain pulse is uniform.

11. The method of claim 10, further comprising the step of selecting the interval between two successive trigger pulses to be greater than or equal to the width at half-height of the average curve of the current intensity of said discharges.

12. The method of claim 8 further comprising the steps of:

generating said sustain pulses with a voltage rising edge, an approximately constant voltage plateau and a voltage falling edge; and, for each sustain pulse, separating the respective beginnings of said plateaus and a first trigger pulse supplied during said sustain pulse by an interval of time less than 100 ns.

13. The method of claim 8, further comprising the steps of:

prior to each sustain phase, for each said frame or said sub-frame, selectively activating some of said discharge regions during an address phase; and, triggering said discharges in combination with said sustain pulses in said activated discharge regions.

14. The method of claim 13, further comprising the step of resetting said discharge regions prior to each said address phase.

15. A method for driving a plasma screen having a plurality of discharge regions and respective electrodes, comprising the steps of:

generating a succession of sustain phases;

supplying image frames or image sub-frames during said sustain phases;

supplying sustain voltage pulses to said discharge regions during said sustain phases, said sustain voltage pulses being incapable on their own of triggering discharges;

supplying trigger voltage pulses successively but at different times to different groups of said discharge regions during said sustain pulses;

triggering said discharges in said discharge regions utilizing trigger pulses in combination with said sustain pulses; and, selecting the interval between two successive trigger pulses to be greater than or equal to the width at half-height of the average curve of the current intensity of said discharges.

16. The method of claim 15 further comprising the steps of:

generating said sustain pulses with a voltage rising edge, an approximately constant voltage plateau and a voltage falling edge; and, separating the respective beginnings of said plateaus and the application of said trigger pulses by an interval of time less than 100 ns.

17. The method of claim 15, further comprising the steps of:

prior to each sustain phase, for each said frame or said sub-frame, selectively activating some of said discharge regions during an address phase; and, triggering said discharges in combination with said sustain pulses in said activated discharge regions.

18. The method of claim 17, further comprising the step of resetting said discharge regions prior to each said address phase.

* * * * *

UNITED STATES PATENT AND TRADEMARK OFFICE

CERTIFICATE OF CORRECTION

PATENT NO. : 7,602,353 B2
APPLICATION NO. : 10/883543
DATED : October 13, 2009
INVENTOR(S) : Lacoste et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1347 days.

Signed and Sealed this

Fifth Day of October, 2010

David J. Kappos

David J. Kappos
*Director of the United States Patent and Trademark Office*